US008701428B2

(12) United States Patent
Lee et al.

(10) Patent No.: US 8,701,428 B2
(45) Date of Patent: Apr. 22, 2014

(54) REFRIGERATOR AND METHOD FOR CONTROLLING THE SAME

(75) Inventors: Nam Gyo Lee, Seoul (KR); Kyung Seok Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 961 days.

(21) Appl. No.: 12/829,454

(22) Filed: Jul. 2, 2010

(65) Prior Publication Data

US 2011/0023511 A1 Feb. 3, 2011

(30) Foreign Application Priority Data

Jul. 28, 2009 (KR) ..... 10-2009-0069013

(51) Int. Cl.
*F25C 5/00* (2006.01)

(52) U.S. Cl.
USPC ..... 62/178; 62/125; 62/126; 62/127; 62/344; 62/389

(58) Field of Classification Search
USPC ..... 62/66, 125–127, 177–178, 340, 344, 62/389, 391
See application file for complete search history.

(56) References Cited

U.S. PATENT DOCUMENTS

| | | | | |
|---|---|---|---|---|
| 5,909,950 | A * | 6/1999 | Seok et al. | 362/94 |
| 7,137,272 | B2 * | 11/2006 | Park et al. | 62/389 |
| 7,997,452 | B2 * | 8/2011 | Kim et al. | 222/182 |
| 8,042,708 | B2 * | 10/2011 | Jeong et al. | 222/146.6 |
| 8,109,301 | B1 * | 2/2012 | Denise | 141/360 |
| 2004/0148958 | A1 * | 8/2004 | Park | 62/381 |
| 2007/0256442 | A1 * | 11/2007 | Lyvers et al. | 62/344 |
| 2009/0009042 | A1 | 1/2009 | Kim et al. | |
| 2009/0178429 | A1 | 7/2009 | Lee et al. | |
| 2010/0082159 | A1 * | 4/2010 | Kim et al. | 700/275 |
| 2010/0089492 | A1 * | 4/2010 | Dirnberger et al. | 141/351 |
| 2010/0180623 | A1 * | 7/2010 | Oh | 62/344 |

OTHER PUBLICATIONS

International Search Report dated Jul. 15, 2010.

* cited by examiner

*Primary Examiner* — Allana Lewin
*Assistant Examiner* — Jonathan Bradford
(74) *Attorney, Agent, or Firm* — KED & Associates, LLP

(57) ABSTRACT

A refrigerator and a method for controlling the same are provided. More particularly, the refrigerator is provided with a dispenser having a cavity for a cup, dispenser doors that open and close the cavity, and a door driver positioned in the dispenser that drives the dispenser doors. The dispenser doors may be automatically controlled to open and close, thereby improving cleanliness and an exterior appearance of the refrigerator by reducing dust accumulation in the dispenser during periods of non-use.

31 Claims, 6 Drawing Sheets

REFRIGERATOR AND METHOD FOR CONTROLLING THE SAME

CROSS-REFERENCE TO RELATED APPLICATION(S)

This application claims priority from Korean Patent Application No. 10-2009-0069013 filed in Korea on Jul. 28, 2009, the entirety of which is incorporated herein by reference.

BACKGROUND

1. Field

A refrigerator and a method for controlling the same are disclosed herein.

2. Background

Refrigerators and methods for controlling the same are known. However, they suffer from various disadvantages.

BRIEF DESCRIPTION OF THE DRAWINGS

Embodiments will be described in detail with reference to the following drawings in which like reference numerals refer to like elements, wherein.

DETAILED DESCRIPTION

Figure 1:
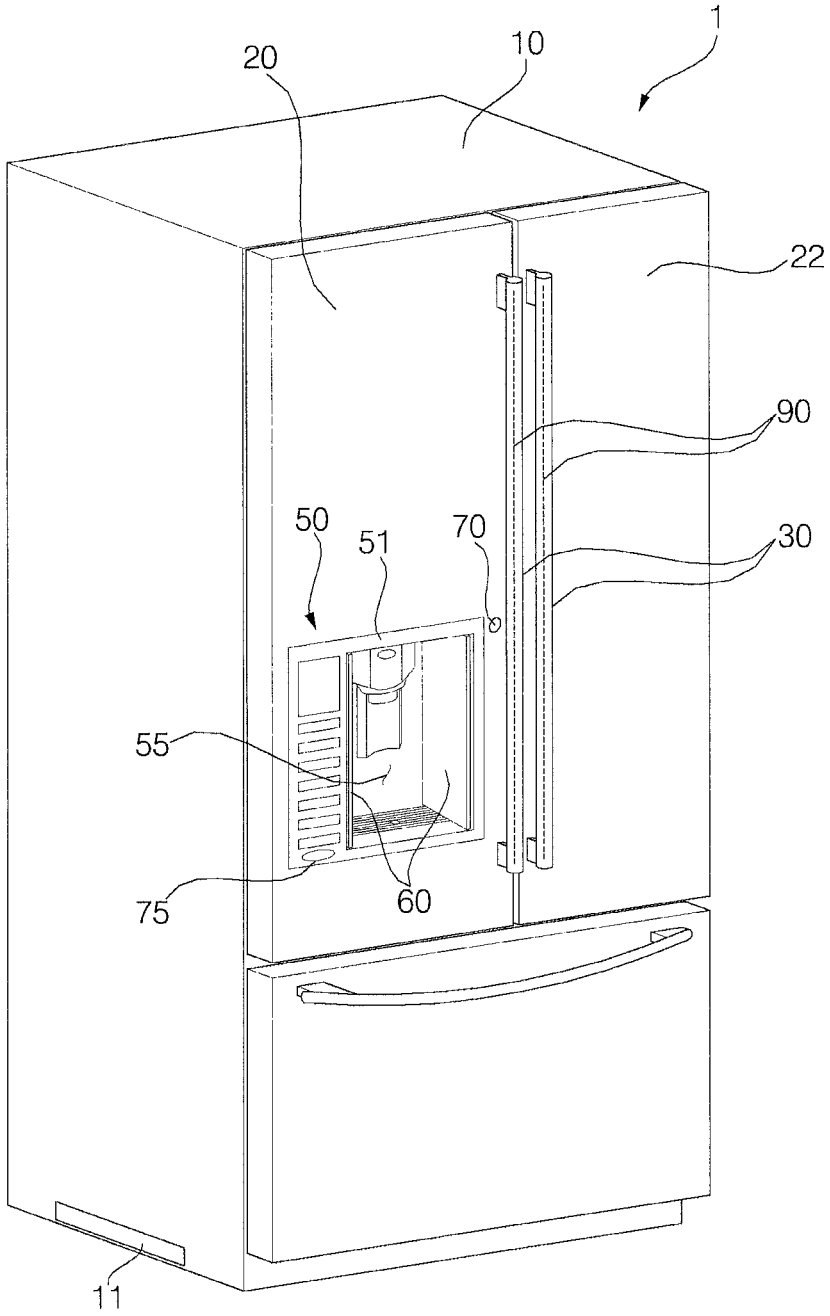
FIG. 1 is a front perspective view of an exterior of a refrigerator according to an embodiment.

Hereinafter, embodiments of a refrigerator and method of controlling the same will be described in detail with reference to drawings. Where possible, like reference numerals have been used to indicate like elements.

In general, a refrigerator is a home appliance that refrigerates or freezes food. The refrigerator may include various parts that drive a refrigeration cycle. The refrigerator may maintain freshness of food stored therein by cooling a food storage chamber using cold air generated by the refrigeration cycle.

Refrigerators tend to be bigger and have more functions according to improvements in shelf life of food and various tastes of users. Devices, such as a dispenser or a homebar, may be added to a door for user's convenience to allow users to easily access frequently accessed items, for example, drinks or ice, without opening food storage chamber doors.

However, conventional refrigerators suffer from disadvantages because a dispenser cavity in which a user's cup may be placed may accumulate dust as a result of being open when not in use. Further, the exterior beauty of the refrigerator may be diminished as the front of the refrigerator may be complicated or cluttered.

Referring to FIG. 1, a refrigerator 1 may be arranged perpendicularly to a surface, such as a kitchen or living room floor, and may include a body 10, which may include a food storage chamber, and refrigerator doors 20 or 22, which may open and close the food storage chamber. The body 10 is not limited to being arranged on a kitchen or living room floor, but rather, may be arranged in an interior wall of a building, for example, as a built-in cabinet type.

The refrigerator 1 may include the food storage chamber, which may be separated into a freezing chamber (not shown) that stores frozen food and a cold-storage chamber (not shown) that stores refrigerated food. Various configurations of the chambers are possible. For example, the freezing chamber may be provided on an upper left section of the body 10, and the cold-storage chamber may be provided on an upper right section of the body 10. A freezing chamber door 20 and a cold-storage chamber door 22 may be provided on each chamber to isolate chilled air inside each respective chamber.

The freezing chamber door 20 and the cold-storage chamber door 22 may each include a door handle 30 configured to be pulled by a user. A contact sensor 90 may be positioned on each door handle 30. The contact sensor 90 may be one of a variety of sensors that senses contact by a user.

A dispenser 50 may be positioned on at least one of the freezing chamber door 20 or the cold-storage chamber door 22. The dispenser 50 may provide access to a beverage, for example, ice or water, without the need to open the freezing chamber door 20 or the cold-storage chamber door 22. The dispenser 50 may also include a cavity 55 in which a cup may be placed to obtain the beverage. The cavity 55 may protrude at one side of the freezing chamber door 20 or the cold-storage chamber door 22, and may be recessed on the other side by a prescribed depth.

As previously described, conventional refrigerators may suffer from the disadvantages that cleanliness was reduced because the cavity 55 was covered by dust due to it being open when not in use, and that the emotional quality of the customer was reduced because the exterior of the refrigerator was complicated and cluttered. Embodiments disclosed herein may overcome these disadvantages by automatically closing the cavity 55 when the dispenser 50 is not in use.

Figure 2:
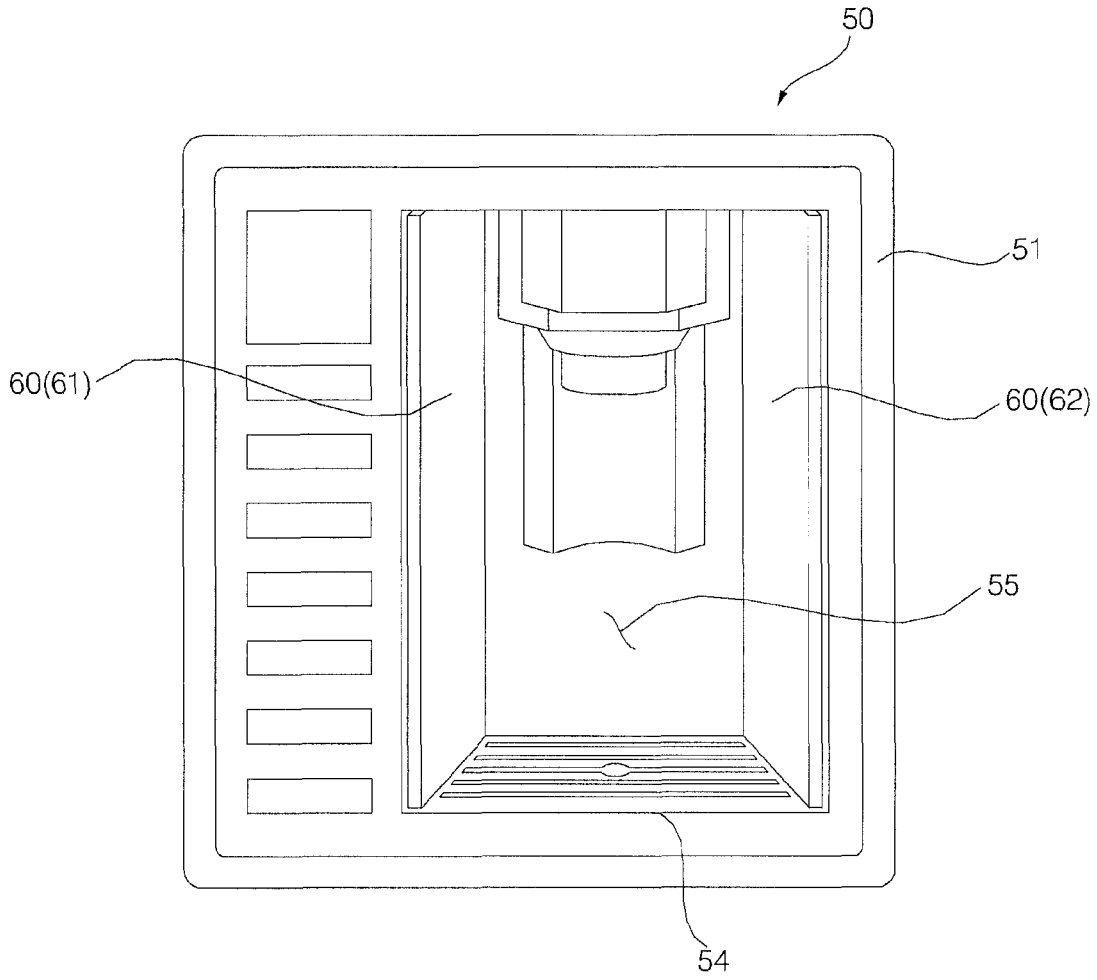
FIG. 2 is a front view of a dispenser according to an embodiment.
Figure 3:
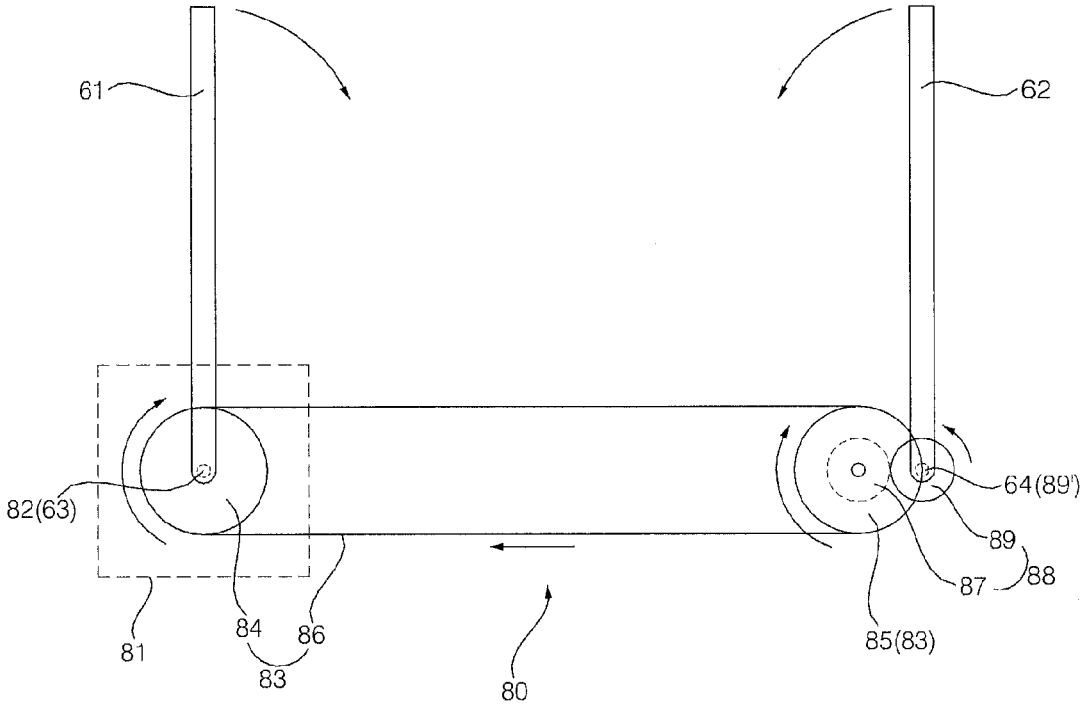
FIG. 3 is a top view of a door driver according to an embodiment.

FIG. 2 is a front view of a dispenser according to an embodiment, and FIG. 3 is a top view of a door driver according to an embodiment. The dispenser 50 of FIG. 2 according to this embodiment may include a dispenser body 51 having an opening 54 at a front thereof, a cavity 55, dispenser doors 60, which may be positioned on the dispenser body 51, that open and close the opening 54, and a door driver 80 that drives the dispenser doors 60.

The dispenser doors 60 may include a first rotary door 61, which may rotate on a first side of the dispenser 50, and a second rotary door 62, which may rotate on a second side of the dispenser 50. For example, the first rotary door 61 and the second rotary door 62 may be positioned on left and right side edges of the opening 54, respectively, and may rotate in either a forward or rearward direction around the side edges to open the cavity 55.

The dispenser doors 60 may open to an inside or outside of the cavity 55. The dispenser doors 60 may also be a sliding door or a hinged door. The cavity 55 may be closed by rotating or sliding the dispenser doors 60 in opposite directions to when opening the cavity 55.

A door driver 80 may drive the dispenser doors 60. Referring to FIG. 3, the door driver 80 may include a drive motor 81 that generates rotary power. The drive motor 81 may rotate the first rotary door 61 by connection with a rotary shaft 63 of the first rotary door 61. Further, the drive motor 81 may be positioned at a top of the dispenser body 51 in a position in which it will not interfere with the rotation of the first rotary door 61 and/or the second rotary door 62.

The door driver 80 may further include a rotary power transmission 83 that transmits rotary power from the drive motor 81 to the second rotary door 62 which may not be connected to the drive motor 81. The rotary power transmission 83 may include a drive pulley 84, which may be positioned on both a rotary shaft 82 of the drive motor 81 and a rotary shaft 63 of the first rotary door 61. The rotary shaft 82 of the drive motor 81, the rotary shaft of the drive pulley 84, and the rotary shaft 63 of the rotary door 61 may be the same shaft.

The rotary power transmission 83 may further include a driven pulley 85, which may be positioned at the second side edge of the dispenser body 51, and a connecting belt 86, which may connect the drive pulley 84 to the driven pulley 85, to transmit the rotary power of the drive pulley 84 to the driven pulley 85.

The door driver 80 may further include a switch gear 88 that rotates the second rotary door 62 in a direction opposite to the first rotary door 61. The switch gear 88 may be connected to the rotary shaft 64 of the second rotary door 62. More particularly, referring to FIG. 3, the switch gear 88 may include a connecting gear 87, which may be positioned on a rotary shaft of the driven pulley 85, and a driven gear 89, which may be positioned on a rotary shaft 64 of the second rotary door 62. Driven gear 89 may be interlocked with the connecting gear 87, and be driven by the connecting gear 87.

In one embodiment, the driven pulley 85 may be positioned at a top of the rotary shaft 64 of the second rotary door 62. The connecting gear 87 and the driven gear 89, which may be interlocked with each other, may be positioned below the driven pulley 85. Further, the rotary shaft 89' of the driven gear 89 may be attached coaxially to the rotary shaft 64 of the second rotary door 62, such that the second rotary door 62 may be driven by the rotation of the driven gear 89. The switch gear 88, including the connecting gear 87 and the driven gear 89, may change the rotational direction of the second rotary door 62 to rotate in an opposite direction as the first rotary door 61. Thus, a single driving motor 81 may simultaneously rotate the first rotary door 61 and the second rotary door 62.

While embodiments have described the drive motor 81 as being positioned at the first rotary door 61, the door driver 80 is not limited thereto. For example, the drive motor 81 may be positioned on a top or bottom of the rotary shaft 64 to drive the right rotary door 62. Further, the rotary power transmission 83, the driven pulley 85, and switch gear 88 may each be positioned either at a top or bottom of the dispenser body 51, and configured to transfer the rotary power from the second rotary door 62 to the first rotary door 61.

Figure 4:
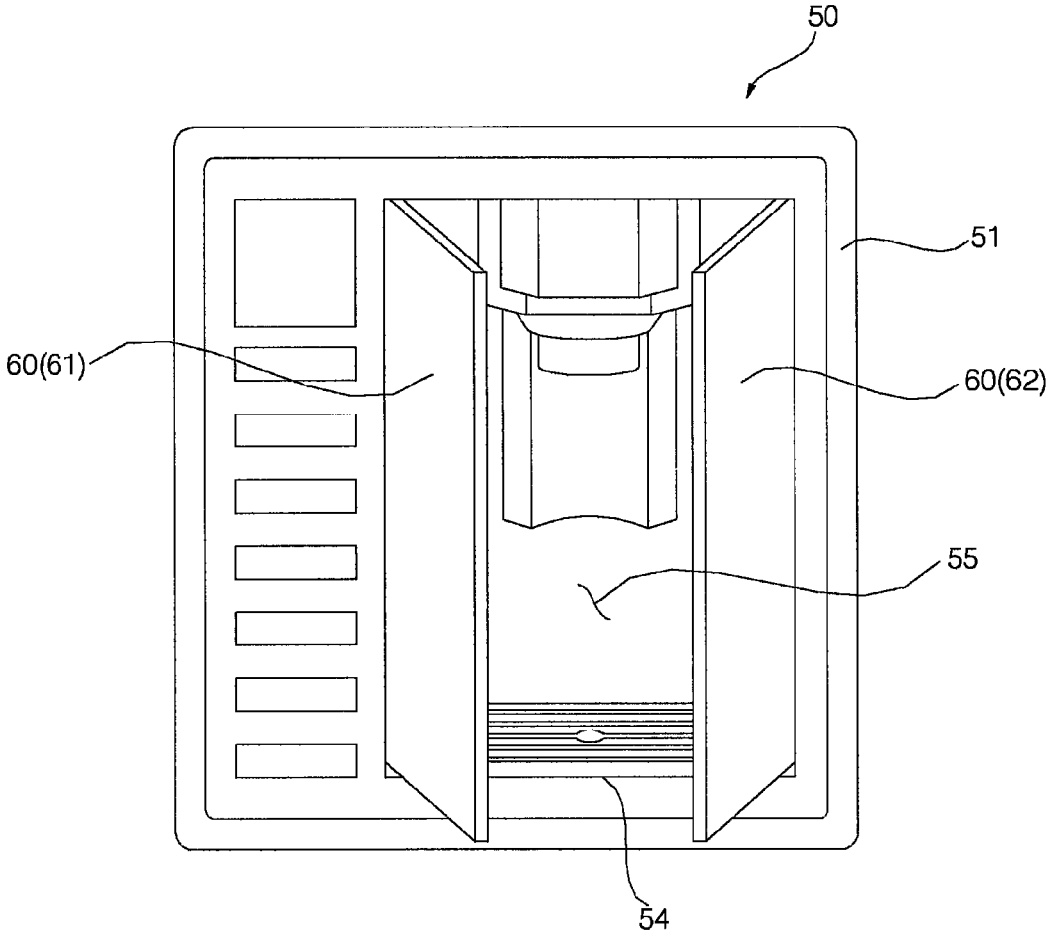
FIG. 4 is a perspective view of a dispenser according to another embodiment.
Figure 5:
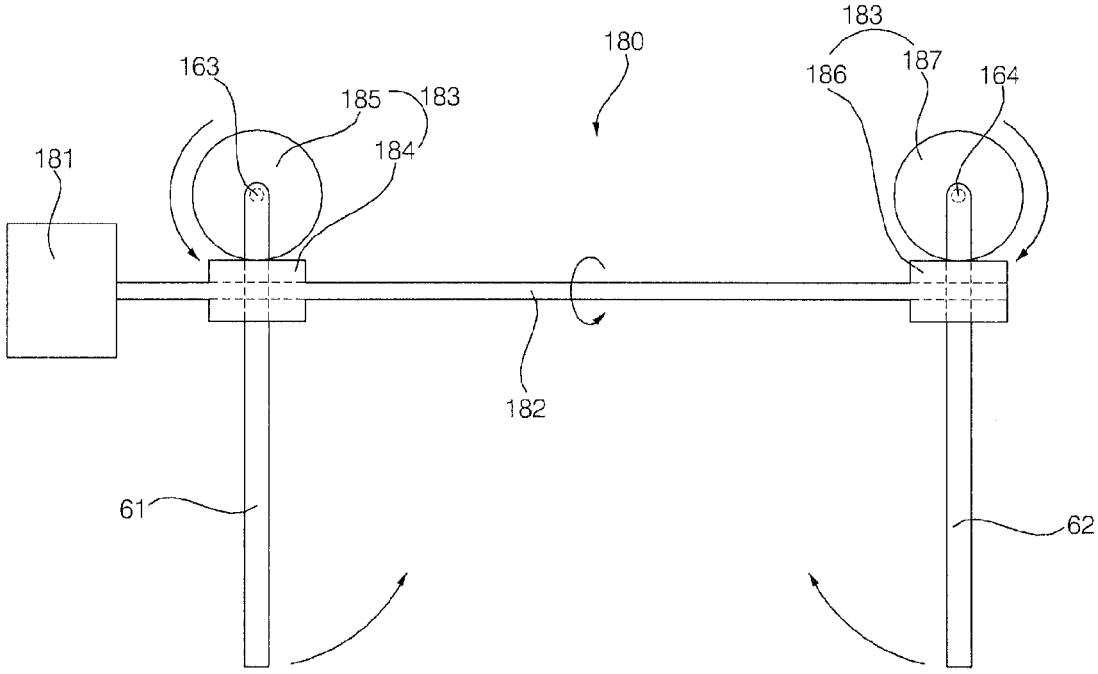
FIG. 5 is a top view of a door driver according to another embodiment.

FIG. 4 is a perspective view of a dispenser according to another embodiment. FIG. 5 is a top view of a door driver according to another embodiment. Referring to FIG. 4 and FIG. 5, in this embodiment, the door driver 180 may be positioned at a top end of the dispenser body 51 and may include a drive motor 181, which may supply rotary power, and a rotary power transmission 183, which may simultaneously transmit rotary power from the driving motor 181 to both the first rotary door 61 and the second rotary door 62.

The rotary power transmission 183 may include a first connecting gear 184, which may be connected to a rotary shaft 182 of the drive motor 181, and a first interlocking gear 185, which may be connected to a rotary shaft 163 of the first rotary door 61. The rotary shaft 163 may be interlocked with the first connecting gear 184 by the first interlocking gear 185. The rotary power transmission 183 may also include a second connecting gear 186 connected to the rotary shaft 182 of the drive motor 181, and a second interlocking gear 187, which may be connected to the rotary shaft 164 of the second rotary door 62. The rotary shaft 164 may be interlocked with the second connecting gear 186 by the second interlocking gear 187.

The rotary shaft 182 of the drive motor 181 may be positioned at an upper part of the dispenser body 51 and may extend from a first side, for example, a left side to a second side, for example, a right side, of the dispenser body 51. The first connecting gear 184 and the second connecting gear 186 may be positioned a predetermined distance apart from each other on the rotary shaft 182. The first interlocking gear 185, which may be positioned on top of the rotary shaft 163 of the first rotary door 61, and the second interlocking gear 187, which may be positioned on top of the rotary shaft 164 of the second rotary door 62, may be interlocked to the first connecting gear 184 and the second connecting gear 186, respectively. Thus, a single drive motor 181 may simultaneously rotate the first rotary door 61 and the second rotary door 62.

The rotational direction of the first rotary door 62 and the rotational direction of the second rotary door 61 may be opposite to each other. The first connecting gear 184 and the second connecting gear 186 may each include a worm gear. For example, if either of the first connecting gear 184 or the second connecting gear 186 is a right-handed screw worm gear, the other may be a left-handed screw worm gear. Also, the first interlocking gear 185 and the second interlocking gear 187 may include a worm wheel gear, which may be interlocked with the first connection gear 184 and the second connecting gear 186, respectively.

While the drive motor 181 of this embodiment is described as being positioned at the top end of the dispenser body 51, the door driver 180 is not limited thereto. For example, the drive motor 181, rotary shaft 182, and the rotary power transmission 183 may also be positioned at a bottom end of the dispenser body 51. Further, drive motor 181 may be positioned at the first rotary door 61, for example, a left rotary door, or the second rotary door 62, for example, a right rotary door.

Referring again to FIG. 1, the refrigerator 1 according to one embodiment may include a movement sensor 70, which may be positioned on a surface of the refrigerator 1 to detect movement of an approaching user or an object, for example, a user's hand or a cup. The refrigerator 1 may further include a controller 11 that controls the door drivers 80 or 180 responsive to the movement sensor 70, such that the dispenser doors 60 are automatically opened only when a user is positioned near the refrigerator. The movement sensor 70 may be a human body detection sensor that detects, for example, movement of a human body, and may include an infrared rays sensor that detects a position and movement of a human body, or an image sensor that detects an image of a human body. The movement sensor 70 may be positioned at the dispenser body 51 or at one of the refrigerator doors 20 or 22. In alternative embodiments, the movement sensor 70 may detect a combination of motion and heat to prevent unintentional activation of the sensor 70 and the dispenser doors 60.

The contact sensor 90 may be positioned on the door handle 30 of the refrigerator doors 20 and/or 22 to detect user contact, for example, a user grabbing the door handle 30. The contact sensor 90 may also detect an initial motion of the refrigerator doors 20 or 22 when a user pulls on the door handle 30 to open the food storage chamber. The contact sensor 90 may include, for example, a pressure sensor or a current sensor installed at the door handle 30. However, the contact sensor 90 may include any sensor that detects the opening of the refrigerator doors 20 or 22.

When a user is within a first predetermined distance of the refrigerator 1, the motion sensor 70 may signal the controller 11 to indicate that a user may be attempting to access the dispenser 50. However, the user's purpose may not be to access the dispenser 50, but to open the refrigerator doors 20 or 22. Thus, the controller 11 may wait a first predetermined period of time to determine whether the contact sensor 90 has also detected a user. If the contact sensor 90 is activated within the first predetermined period of time, the controller 11 may conclude that the user does not intend to use the dispenser 50 and may not activate the door drivers 80 or 180. However, if the user does not open the refrigerator doors within the first predetermined period of time, the controller 11 may conclude that the user wishes to access the dispenser 50, and may activate the door drivers 80 or 180 to open the dispenser doors 60.

In an alternative embodiment, the controller 11 may be configured to override either one or both sensors 70 and 90 to open the dispenser doors 60. For example, a button 75 may be installed on the dispenser body 51, or at one of the refrigerator doors 20 or 22, to manually open or close the dispenser doors 60. Alternatively, the controller 11 may disregard a signal from the contact sensor 90 to open the dispenser doors 60 when a user is within a predetermined minimum distance from the dispenser 50. For example, the controller 11 may conclude that a user intends to both open a refrigerator door 20 or 22 and access the dispenser 50 when the user's hand, or cup, is detected by the sensor 70 to be within a predetermined minimum distance from the dispenser doors 60. Then, the controller 11 will ignore the signal from the contact sensor 90 and open the dispenser doors 60.

The controller 11 may automatically close the cavity 55 when the dispenser 50 is not in use. The controller 11 may determine the dispenser 50 to be no longer in use if the motion sensor 70 detects that a user has moved outside a second predetermined distance from the cavity 55. The controller 11 may also close the dispenser doors 60 after a second predetermined period of time after the user was first detected by the human body detection sensor 70 or after the dispenser doors 60 were opened. Alternatively, the second predetermined period of time may be measured from when the sensor 70 detects that the user has moved outside the second predetermined distance from the cavity 55. The second predetermined period of time may be preset by the user or the manufacturer, and may be determined by considering a sufficient amount of time required to operate the dispenser 50, for example, the amount of time needed to get drinks after the cavity 55 is opened.

Figure 6:
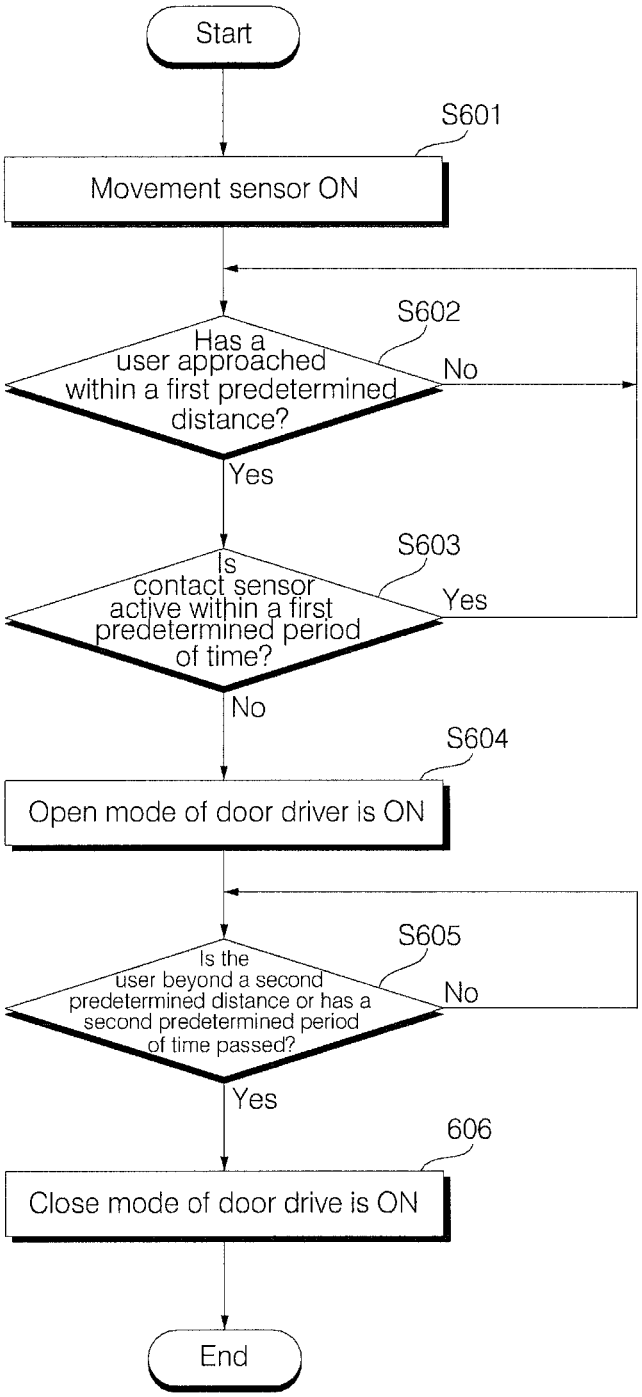
FIG. 6 is a flowchart of a method for controlling the door driver as shown in FIG. 3 and FIG. 5.

A method for controlling a dispenser according to an embodiment is described hereinbelow. FIG. 6 is a flowchart of a method for controlling a dispenser having a door driver, such as door driver 80 or 180 shown in FIG. 3 and FIG. 5. Referring to FIG. 6, in step S602, the motion sensor 70 may detect a user within a first predetermined distance of the cavity 55. Thereafter, the controller 11 may wait a predetermined period of time for a signal from the contact sensor 90 to determine whether the user intends to access the dispenser 50 or the food storage chamber.

The controller 11 may then determine whether the contact sensor 90 is active, in step S603. If a signal is received from the contact sensor 90, the controller 11 may conclude that the user's purpose is to open the food storage chamber by pulling the handle 30 of the refrigerator doors 20 or 22, and determine that the dispenser doors 60 should not be opened. If the signal is not received from the contact sensor 90 within a first predetermined period of time, the controller 11 may conclude the dispenser doors 60 should be opened. The controller 11 may then control the driving motors 81 or 181 of the door drivers 80 or 180 to open the dispenser doors 60 of the cavity 55, in step S604.

In step S605, the controller 11 may determine whether the cavity 55 should be closed. If the motion sensor 70 detects that the user has moved beyond a second predetermined distance from the cavity 55 or if a second predetermined period of time has passed since the user was first detected by the motion sensor 70, the controller 11 may determine that the cavity 55 should be closed. In step S606, the controller 11 may close the dispenser doors 60.

Embodiments disclosed herein relate to a refrigerator, and more particularly, to a refrigerator which simplifies the front exterior and maintains the cleanliness by automatically opening the cavity of the dispenser body, which is exposed to the outside, only in a case in which users use the dispenser to allow the users to obtain drinks without opening the refrigerator doors, and closing the cavity of the dispenser body in a case in which users do not use the dispenser.

A refrigerator as broadly described and embodied herein may include a door which opens and closes a food storage chamber, a dispenser body disposed at the door and having an opening part at a front and a cavity in which a cup goes in or out, a dispenser door disposed in the dispenser body to open and close the opening part, and a door driver disposed in the dispenser body to drive the door.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator, comprising:

a door that opens and closes a food storage chamber;

a dispenser body positioned on the door, the dispenser comprising an opening and a cavity;

a dispenser door configured to open and close the opening;

a door driver that drives the dispenser door;

a human body detection sensor positioned on a surface of the refrigerator; and configured to detect a movement and a position of a user;

a controller configured to operate the door driver to drive the dispenser door in response to signals from the human body detection sensor; and a contact sensor positioned on a door handle of the refrigerator, configured to sense a user contact, wherein the controller does not operate the door driver to open the opening if the contact sensor senses contact, and wherein the controller operates the door driver to open the opening if the human body detection sensor senses movement of the user and the contact sensor does not sense a user contact.

2. The refrigerator of claim 1, wherein the door driver is positioned in the dispenser body.

3. The refrigerator of claim 1, wherein the controller is configured to operate the door driver to drive the dispenser door to open the opening upon the human body detection sensor sensing that a user is within a first predetermined distance and close the opening upon the human body detection sensor sensing that a user is outside of a second predetermined distance.

4. The refrigerator of claim 1, wherein the controller is configured to operate the door driver to drive the dispenser door to open the opening upon the human body detection sensor sensing that the user is within a first predetermined distance and close the opening after a predetermined period of time.

5. The refrigerator of claim 1, wherein the dispenser door comprises:

a first rotary door positioned to rotate at a first side of the opening; and a second rotary door positioned to rotate at a second side of the opening.

6. The refrigerator of claim 5, wherein the first rotary door is positioned to rotate at a left side of the opening, and the second rotary door is positioned to rotate at a right side of the opening, and wherein each of the first rotary door and the second rotary door opens the opening by rotating to an inside or outside of the cavity.

7. The refrigerator of claim 5, wherein the door driver simultaneously rotates the first rotary door and the second rotary door.

8. The refrigerator of claim 5, wherein the door driver comprises:

a drive motor configured to rotate the first rotary door; and a rotary power transmission configured to transmit rotary power from the drive motor to the second rotary door.

9. The refrigerator of claim 8, wherein the drive motor rotates the first rotary door by connection to a rotary shaft of the first rotary door.

10. The refrigerator of claim 8, wherein the rotary power transmission comprises:

a drive pulley positioned on the rotary shaft of the drive motor;

a rotatable driven pulley positioned on the dispenser body;

a connecting belt connected to the drive pulley and the driven pulley, the connecting belt being configured to transmit the rotary power of the drive pulley to the driven pulley; and a switch gear positioned at a rotary shaft of the driven pulley and connected to the second rotary door.

11. The refrigerator of claim 10, wherein the switch gear comprises:

a connecting gear connected to the rotary shaft of the driven pulley; and a driven gear connected to the rotary shaft of the second rotary door, configured to rotate by connection with the connecting gear.

12. The refrigerator of claim 8, wherein the drive motor and the first rotary door are configured to rotate in a direction to open the first rotary door into the cavity.

13. The refrigerator of claim 8, wherein the drive motor and the first rotary door are configured to rotate in a direction to open the first rotary door away from the cavity.

14. The refrigerator of claim 8, wherein the drive motor is positioned in the dispenser body above the first rotary door.

15. The refrigerator of claim 8, wherein the rotary power transmission is configured to simultaneously transmit the rotary power from the drive motor to the first rotary door and the second rotary door.

16. The refrigerator of claim 8, wherein the rotary power transmission comprises:

a first connecting gear and a second connecting gear connected to the rotary shaft of the drive motor;

a first interlocking gear connected to a rotary shaft of the first rotary door; and a second interlocking gear connected to a rotary shaft of the second rotary door, wherein the first interlocking gear is coupled to the first connecting gear and the second interlocking gear is coupled to the second connecting gear.

17. The refrigerator of claim 16, wherein the first connecting gear and the second connecting gear each comprises a worm gear configured to rotate with the rotary shaft of the drive motor, and wherein the first interlocking gear and the second interlocking gear each comprises a worm wheel gear configured to be interlocked with a respective one of the first connecting gear and the second connecting gear.

18. The refrigerator of claim 17, wherein one of the first connecting gear or the second gear comprises a right-handed worm gear, and another comprises a left-handed worm gear, and wherein the drive motor is configured to rotate the first rotary door and the second rotary door rotate to an inside or outside of the cavity.

19. A method of controlling a refrigerator, comprising:

detecting a movement and a position of a user;

determining whether the user intends to use a dispenser of the refrigerator;

automatically opening a dispenser door if the user intends to use the dispenser;

determining whether the user has finished using the dispenser; and automatically closing the dispenser door if the user has finished using the dispenser, wherein the detecting the movement and the position of the user includes sensing that a user has approached within a first predetermined distance of the dispenser, and wherein the determining whether the user intends to use the dispenser includes waiting a first predetermined period of time after detecting the movement and position of the user for a signal from a contact sensor positioned on a refrigerator door handle of the refrigerator, the contact sensor being configured to provide a signal to a controller when the user touches the refrigerator door handle, and determining the user intends to use the dispenser if the user does not touch the refrigerator door handle within the first predetermined period of time after approaching the dispenser within the first predetermined distance.

20. The method of claim 19, wherein the automatically opening the dispenser door comprises controlling by the controller a door driver to rotate the dispenser door.

21. The method of claim 20, wherein the determining whether the user has finished using the dispenser comprises:

sensing that the user has moved beyond a second predetermined distance from the dispenser; or determining that a second predetermined period of time has passed since the dispenser door opened.

22. The method of claim 20, wherein the dispenser door comprises a left rotary door and a right rotary door.

23. The method of claim 22, wherein a single drive motor simultaneously rotates the left and right rotary doors to open the dispenser.

24. The method of claim 19, wherein the sensing is performed by a motion sensor.

25. The method of claim 24, wherein the motion sensor comprises a human body detection sensor.

26. A refrigerator, comprising:

a door that opens and closes a food storage chamber;

a dispenser body positioned on the door, the dispenser comprising an opening and a cavity;

a dispenser door configured to open and close the opening; and a door driver that drives the dispenser door, wherein the dispenser door includes a first rotary door positioned to rotate at a first side of the opening, and a second rotary door positioned to rotate at a second side of the opening, wherein the door driver includes a drive motor configured to rotate the first rotary door, and a rotary power transmission configured to transmit rotary power from the drive motor to the second rotary door, and wherein the rotary power transmission includes a first connecting gear and a second connecting gear connected to the rotary shaft of the drive motor, a first interlocking gear connected to a rotary shaft of the first rotary door, and a second interlocking gear connected to a rotary shaft of the second rotary door, wherein the first interlocking gear is coupled to the first connecting gear and the second interlocking gear is coupled to the second connecting gear.

27. The refrigerator of claim 26, wherein the first connecting gear and the second connecting gear each includes a worm gear configured to rotate with the rotary shaft of the drive motor, and wherein the first interlocking gear and the second interlocking gear each includes a worm wheel gear configured to be interlocked with a respective one of the first connecting gear and the second connecting gear.

28. The refrigerator of claim 27, wherein one of the first connecting gear or the second gear includes a right-handed worm gear, and another includes a left-handed worm gear, and wherein the drive motor is configured to rotate the first rotary door and the second rotary door rotate to an inside or outside of the cavity.

29. The refrigerator of claim 28, further comprising a human body detection sensor positioned on a surface of the refrigerator, and configured to detect a movement and a position of a user.

30. The refrigerator of claim 29, further including a controller configured to operate the door driver to drive the dispenser door in response to signals from the human body detection sensor.

31. The refrigerator of claim 30, further including a contact sensor positioned on a door handle of the refrigerator, and configured to sense a user contact.

* * * * *